United States Patent [19]

Higuchi et al.

[11] Patent Number: 4,954,207

[45] Date of Patent: Sep. 4, 1990

[54] APPARATUS FOR AUTOMATICALLY TAPING ELECTRONIC COMPONENTS

[75] Inventors: Hirokazu Higuchi; Mitsuro Hamuro, both of Kyoto, Japan

[73] Assignee: Murata Manufacturing Co., Ltd., Japan

[21] Appl. No.: 317,639

[22] Filed: Mar. 1, 1989

[30] Foreign Application Priority Data

Mar. 2, 1988 [JP] Japan ..... 63-50540

[51] Int. Cl.[5] ..... B65H 5/26

[52] U.S. Cl. ..... 156/552; 53/591; 198/477.1; 221/74

[58] Field of Search ..... 156/552, 562; 198/476.1, 477.1; 221/74, 81; 53/591

[56] References Cited

U.S. PATENT DOCUMENTS

| | | | |
|---|---|---|---|
| 3,421,284 | 1/1969 | Zemek | 156/552 |
| 3,669,309 | 6/1972 | Romeo | 156/552 |
| 4,447,287 | 5/1984 | Hofbauer | 156/552 |
| 4,737,227 | 4/1988 | Foster et al. | 156/552 |

*Primary Examiner*—Michael W. Ball
*Assistant Examiner*—Chester T. Barry
*Attorney, Agent, or Firm*—Ostrolenk, Faber, Gerb & Soffen

[57] ABSTRACT

A method and apparatus for handling electronic components. The method includes: (a) advancing an elongated support member in a first direction; (b) automatically extracting electronic components from the elongated support member in a second direction while the elongated support member is advancing in the first direction, the second direction being substantially perpendicular to the first direction; and (c) placing the electronic components on an elongated first tape and applying a second tape to the first tape to fix the electronic components between the tapes. The spacing between the electronic components within the support assembly and the spacing between the electronic components fixed between the tapes may be different. A sensor may be provided to sense the presence or absence of an electronic component within the apparatus.

17 Claims, 7 Drawing Sheets

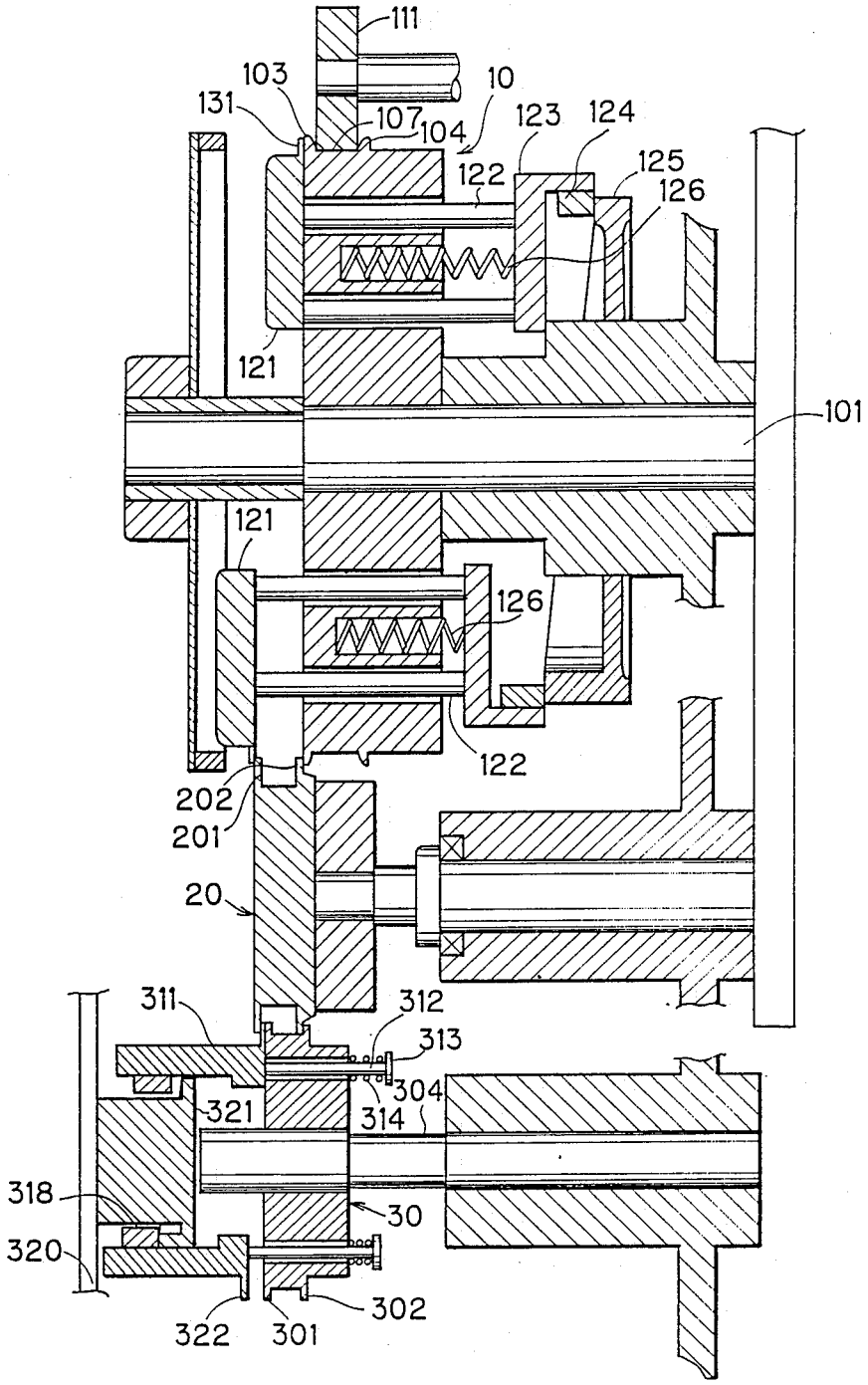
111
103
10
131
107
104
123
124
125
122
126
121
101
121
126
122
202
201
20
311
312
313
304
321
314
318
30
320
302
322
301

APPARATUS FOR AUTOMATICALLY TAPING ELECTRONIC COMPONENTS

BACKGROUND OF THE INVENTION

1. Field of the Invention

This invention relates to an apparatus for automatically taping electronic components to provide a taped electronic component series, wherein from an electronic component assembly having a plurality of lead wire-equipped electronic components held on a long-sized support member such as ground paper, said electronic components are extracted.

2. Description of the Background Art

To produce a taped electronic component series, first, as shown in FIG. 2A, lead wires 3 are inserted into ground paper 2 having cuts 1 formed therein, and in this state, electronic component elements 4 are connected to the respective lead wires 3 to complete electronic components 5 on the ground paper 2, thereby providing an electronic component assembly 6. Subsequently, the electronic components 5 are extracted from the electronic component assembly 6 to produce a taped electronic component series 7 shown in FIG. 2B. In this case, the electronic components 5 are placed on an elongated tape body 8 at a regular pitch and an adhesive tape 9 is applied thereto to fix the electronic components 5 in position.

In this connection, to produce the taped electronic component series 7 from the electronic component assembly 6, it has been common practice to use a chuck or the like to extract the electronic components 5 one by one and then tape them together.

However, since the electronic components 5 are extracted one by one from the electronic component assembly 6 by chuck or the like and then placed on the tape body 8, it has been impossible to perform taping at high speed.

SUMMARY OF THE INVENTION

Accordingly, an object of the invention is to provide an automatic taping apparatus for electronic components which is capable of high speed taping.

Accordingly, the present invention is directed to a method and apparatus for handling electronic components, comprising: (a) advancing an elongated support member in a first direction; (b) automatically extracting electronic components from the elongated support member in a second direction while the elongated support member is advancing in the first direction, the second direction being substantially perpendicular to the first direction; and (c) placing the electronic components on an elongated first tape and applying a second tape to the first tape to fix the electronic components between the tapes.

A preferred automatic taping apparatus according to the invention is an apparatus for extracting electronic components from an electronic component assembly shown in FIG. 2A and taping them together as shown in FIG. 2B, and comprises a first rotary drum for receiving electronic components on its outer peripheral surface and in which the operation of extraction of electronic components from an electronic component assembly is performed, a second rotary drum for receiving the electronic components extracted from the first rotary drum, and a third rotary drum which receives the electronic components from the second rotary drum and which allows taping to be performed on its outer peripheral surface.

The first rotary drum has a lead wire retaining portions arranged around its outer peripheral edge at a pitch corresponding to the pitch of the components on the support member of an electronic component assembly. The apparatus further includes support member pressing means for pressing the support member of the electronic component assembly against the outer peripheral surface of the first rotary drum, and a plurality of electronic component extracting means attached so that, although they are rotated together with the first rotary drum, their distance to one end surface of the first rotary drum can be changed. The electronic component extracting means are formed around the first drum's peripheral edge with lead wire retaining portions for retaining the lead wires of the electronic components, the lead wire retaining portions being disposed at the same pitch as the lead wire retaining portions of the first rotary drum. Further, the automatic taping apparatus includes first urging means for urging the electronic component extracting means to abut against the surface of the first rotary drum, and a first cam for moving the electronic component extracting means away from the end surface of the first rotary drum to extract the electronic components on the first rotary drum by the electronic component extracting means.

Further, the second rotary drum is also provided around its outer peripheral edge with lead wire retaining portions in which the lead wires of the electronic components can fit. The lead wire retaining portions of the second rotary drum are disposed side by side with the lead wire retaining portions of the first rotary drum.

Further, the third rotary drum is also provided around its outer peripheral edge with lead wire retaining portions in which the lead wires can fit, the lead wire retaining portions being disposed to overlap the lead wire retaining portions of the second rotary drum. Further, there are a plurality of electronic component positioning means disposed so that, while they are rotated together with the third rotary drum, they are moved away from the third rotary drum. These electronic component positioning means have an outer peripheral edge shape such that their outer peripheral edges, when put together, substantially coincide with the outer peripheral edge of the third rotary drum, each of the outer peripheral edges being provided with lead wire retaining portions disposed at the same pitch as the lead wire retaining portions of the third rotary drum.

The automatic taping apparatus also includes second urging means for urging the electronic component positioning means to abut against the third rotary drum, and a second cam for moving the electronic component positioning means away from the third rotary drum to correctly position the electronic components on the tape body. Further, the automatic taping apparatus includes tape body feeding means for feeding a tape body to the outer peripheral surface of the third drum, and an adhesive tape feeding means for feeding an adhesive tape to the surface of a tape body held on the outer peripheral surface of the third rotary drum.

The apparatus can be operated without a chuck.

Further, by changing either the pitch between the lead wire retaining portions on the first rotary drum, that is, the first pitch, or the pitch between the lead wire retaining portions on the second rotary drum, that is, the second pitch, it is possible to tape electronic components at a pitch which differs from the pitch between the electronic components on the electronic component assembly. By suitably selecting the first and second pitches, electronic components can be taped at various pitches.

The foregoing and other objects, features, aspects and advantages of the invention will become more apparent from the following detailed description of a preferred embodiment of the invention, taken in conjunction with the accompanying drawings.

BRIEF DESCRIPTION OF THE DRAWINGS

FIG. 1 is a side sectional view of a taping apparatus according to a preferred embodiment of the invention;

DESCRIPTION OF THE PREFERRED EMBODIMENTS

Figure 3:
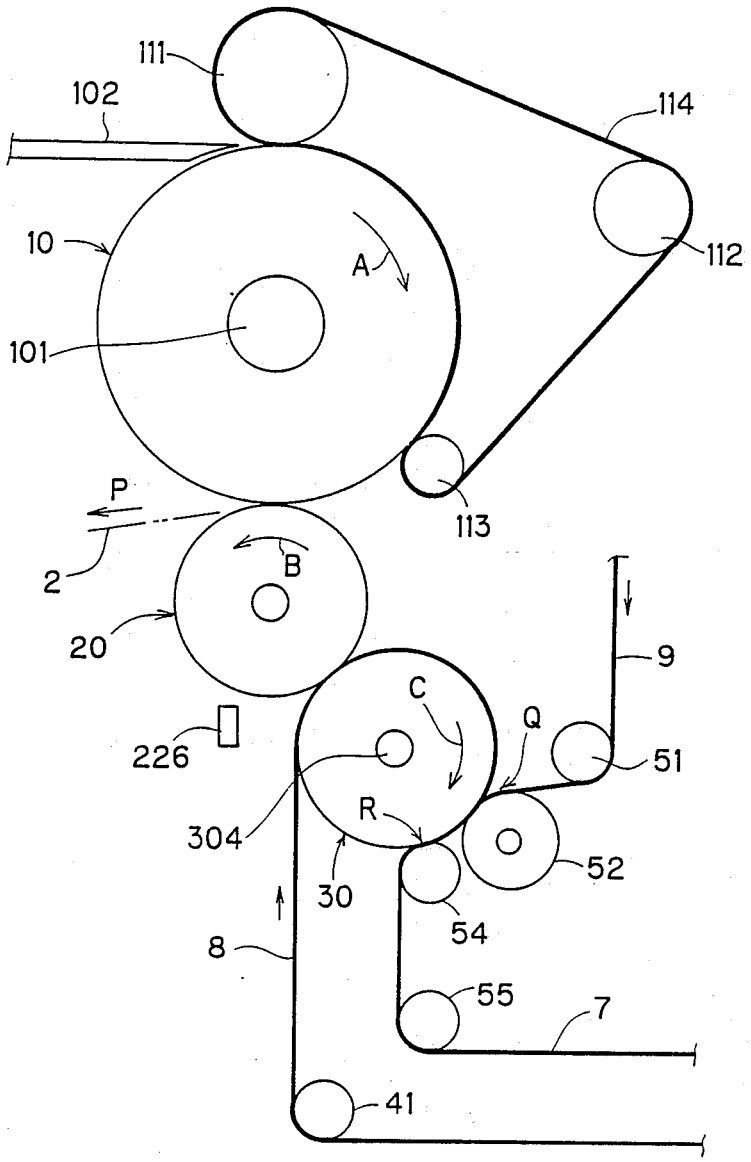
FIG. 3 is a front view schematically showing the arrangement of the FIG. 1 embodiment.

FIGS. 1 and 3 are a schematic side sectional view and a schematic front view, respectively, of a taping apparatus according to an embodiment of the invention. In addition, in FIG. 1, some elements are omitted from the illustration.

The taping apparatus comprises a first rotary drum 10, a second rotary drum 20 and a third rotary drum 30. These rotary drums have lead wire retaining portions disposed to overlap each other, as will be later described.

Figure 2A:
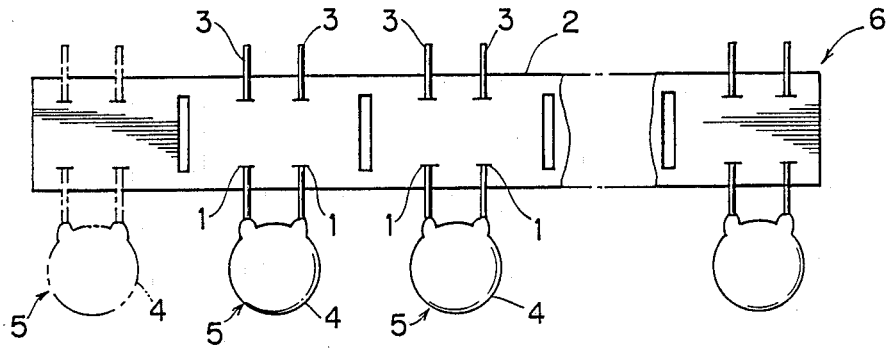
FIG. 2A is a plan view showing an electronic component assembly.

An electronic component assembly 6 (FIG. 2A) is fed to the first rotary drum 10, and on the peripheral surface thereof, electronic components 5 are extracted from ground paper 2. Further, extracted electronic components 5 are given to the second rotary drum 20 and then transferred to the third rotary drum 30. On the third rotary drum 30, the electronic components 5 are assembled to provide a taped electronic component series 7 shown in FIG. 2B.

The first through third rotary drums will now be described in order starting with the drum 10.

The first rotary drum 10 is rotatable around a shaft 101 and is driven by an unillustrated rotary drive source in a clockwise direction as indicated by an arrow A in FIG. 3. As shown in FIG. 3, above the rotary drum 10, there is a rail 102 disposed with its end close to the outer peripheral surface of the first rotary drum 10. The electronic component assembly 6 is fed from the rail 102 onto the outer peripheral surface of the first rotary drum 10.

Figure 4:
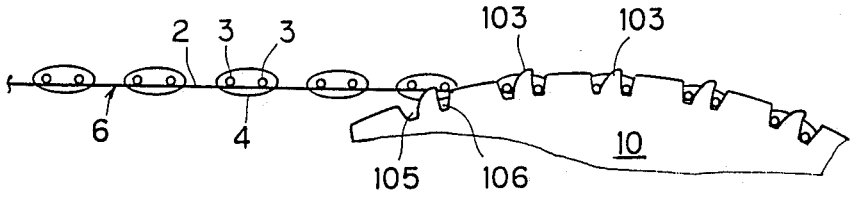
FIG. 4 is a front view showing how electronic components are fed to a first rotary drum.

The outer peripheral surface of the first rotary drum 10 is formed with pawls 103 and 104, as shown in FIG. 1. The pawls 103 and 104 are formed so that, as shown in FIG. 4 with reference to the pawls 103, such pawls 103 and 104 are disposed at a first pitch along the outer peripheral edge of the first rotary drum 10. The pawls 103 and 104 have a shape similar to a quasi-cycloidal curve. The purpose is to make it easier for lead wires 3 to fit in lead wire receiving recesses 105 and 106 formed on both sides of each of the pawls 103. The lead wire receiving recesses 105 and 106 or lead wire retaining portions are formed on both sides of each of the pawls 103 and 104.

Figure 5:
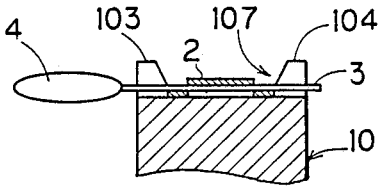
FIG. 5 is a fragmentary sectional view showing an electronic component on the outer peripheral surface of the first rotary drum.

On the other hand, a groove 107 is formed between the pawls 103 and 104, as shown in FIG. 1. The groove 107 is adapted to receive the ground paper 2 of the electronic component assembly 6. This state is shown in FIG. 5.

Referring back to FIG. 3, the first rotary drum 10 is topped with a roller 111. The roller 111 presses against the drum 10. The roller 111 serves to press the ground paper 2 between it and the groove 107. Further, the groove 107 of the first rotary drum 10. Further, besides the roller 111, there is a second roller 112 positioned laterally away from the first rotary drum 10. A pressing belt 114 of elastic material is entrained around the rollers 111 through 113. The pressing belt 114 serves to hold the electronic component assembly 6 onto to the outer peripheral surface of the first rotary drum 10. Therefore, the electronic component assembly 6 is transported clockwise (as indicated by the arrow A) together with the first rotary drum 10 while it is held on the outer peripheral surface of the first rotary drum 10.

Figure 6:
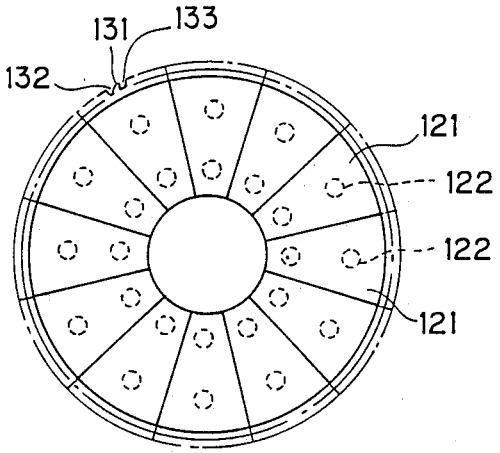
FIG. 6 is a front view showing movable plates constituting electronic component extracting means.

Referring to FIG. 1, disposed forwardly of the first rotary drum 10 are movable plates 121 serving as a plurality of electronic component extracting means. The movable plates 121, as shown in FIG. 6, are formed by dividing a circle corresponding to the first rotary drum 10 into 12 equal parts. Each movable plate 121 is fixed by shafts 122 to a plate 123 on the opposite side of the first rotary drum 10. The shafts 122 are inserted in the first rotary drum 10 and are movable axially of the first rotary drum 10. Further, a coiled spring 126 serving as first urging means urges each plate 123 rearwardly of the first rotary drum 10. That is, the coiled springs 126 urge the movable plates 121 against the front end surface of the first rotary drum 10.

On the other hand, disposed rearwardly of each plate 123 is a follower member 124 which is engaged with a cam 125 fixedly installed to surround the shaft 101. That is, the cam 125 is shaped so that it progressively projects forward as the lower region is approached. Therefore, the plates 123 and hence the movable plates 121 are moved forwardly against the coiled springs 126 as the lower region is approached.

In this connection, the outer peripheral edge of each movable plate 121, as shown in FIG. 6, is formed with pawls 131 at the same pitch and in the same manner as the pawls 103 and 104. Preferably, there is a one-to-one correspondence between the pawls 131 and the movable plates 121. Therefore, the lead wires 3 will be received in the lead wire retaining portions 132 and 133 formed on both sides of the pawls 131. Further, when the movable plates 121 are positioned in the lower region of the first rotary drum 10, they are pushed forward by the cam 125, so that the electronic component elements 4 are extracted forward from the electronic component assembly 6 held on the outer peripheral surface of the first rotary drum 10. As a result, the lead wires 3 extend between the lead wire retaining portions 132, 133 on both sides of the pawls 131 and the lead wire retaining portions (lead wire receiving recesses 105, 106, shown in FIG. 4) on both sides of the pawls 103 associated with the first rotary drum 10. This state is shown in FIG. 7.

While the electronic components 5 are extracted from the electronic component assembly 6 in the manner described above, the ground paper 2 is automatically discharged out of the apparatus so that it may not reach the peripheral surface of the second rotary drum 20, as shown by an arrow P in FIG. 3.

Figure 7:
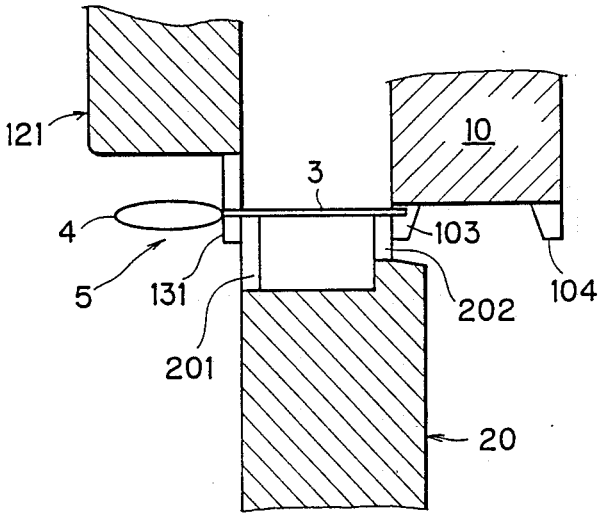
FIG. 7 is a fragmentary sectional view for explaining how an electronic component is transferred from the first rotary drum to the second rotary drum.
Figure 8:
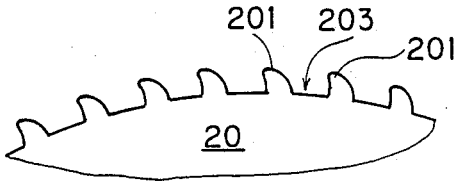
FIG. 8 is an enlarged front view showing pawls formed around the outer peripheral edge of the second rotary drum.
Figure 9:
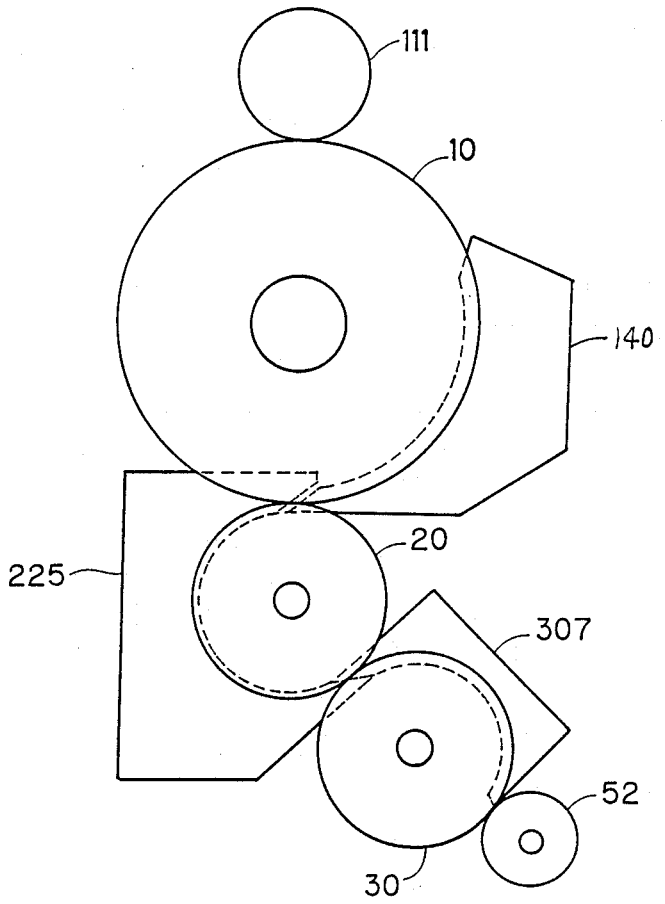
FIG. 9 is a front view illustrating guides attached to the periphery of each rotary drum.

The electronic components 5 extracted in the manner shown in FIG. 7 are transferred to the second rotary drum 20 below the first rotary drum 10. The second rotary drum 20 is also formed around its outer peripheral edge with pawls 201 having a lateral surface shape defined by a quasi-cycloidal curve, as shown in FIG. 8. Lead wire retaining portions 203 are formed between the pawls 201. Further, in the same manner as the pawls 201, the second rotary drum 20 is formed with pawls 202 (see FIG. 7). The lead wire retaining portions 203 are positioned side by side with the lead wire retaining portions (lead wire receiving recesses 105 and 106) of the first rotary drum 10. Electronic components 5 carried to the lower region of the first rotary drum 10 are transferred to the lead wire retaining portions 203. The second rotary drum 20 is rotated in a counterclockwise direction, i.e. in the opposite direction to the first rotary drum 10, as indicated by an arrow B in FIG. 3. In addition, as shown in FIG. 9, disposed on the left side of the second rotary drum 20 along the path of travel of the electronic components 5 is a guide 225 to prevent the electronic components 5 from falling out of the lead wire retaining portions 203. A guide 140 for guiding the electronic components 5 is also provided.

Further, as shown in FIG. 3, disposed below the second rotary drum 20 is a sensor 226 for detecting the presence or absence of the electronic component 5. The sensor 226 detects whether or not electronic component 5 is received in each of the lead wire retaining portions 203. If there is a portion 203 with no electronic component 5 received therein, the rotary drive of the third rotary drum 30 is stopped, whereby a taped electronic component series 7 having no missing electronic component is obtained without fail.

Figure 10:
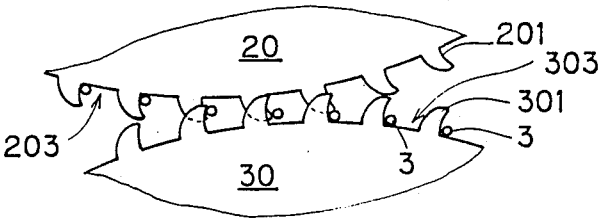
FIG. 10 is a fragmentary enlarged front view showing the connecting region between the second and third rotary drums.

Disposed below the second rotary drum 20 is the third rotary drum 30. In this case, as shown in FIG. 1, the outer peripheral edge of the third rotary drum 30 is formed with pawls 301 and 302 overlapping the pawls 201 and 202 of the second rotary drum 20. The pawls 301 and 302 also have a lateral surface shape defined by a quasi-cycloidal curve, and have lead wire retaining portions 303 (FIG. 10) on both sides thereof. Thus, as shown in FIG. 10, electronic components 5 (only the lead wires 3 thereof are shown in FIG. 10) carried in by the second rotary drum 20 are transferred with the lead wires 3 being received in the lead wire retaining portions 303 on both sides of the pawls 301.

Referring back to FIG. 3, the third rotary drum 30 is rotatable around a shaft 304 and rotated in the direction of arrow C, i.e., clockwise. Further, disposed at the upper right of the third rotary drum 30 is a guide 307 as shown in FIG. 9. The guide 307, like the guide 225, prevents transferred electronic components 5 from falling out of the apparatus.

Figure 11:
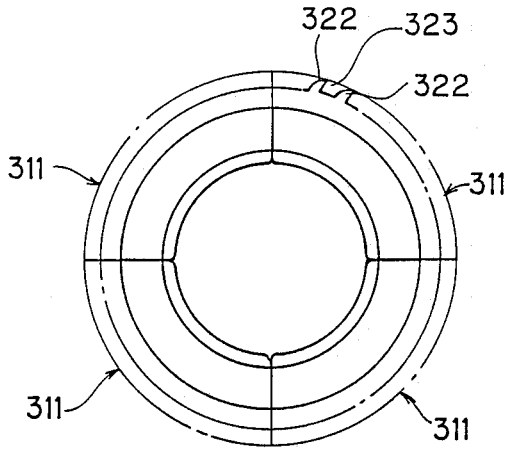
FIG. 11 is a front view of electronic component positioning plates.

Further, disposed forwardly of the third rotary drum 30, as shown in FIG. 1, are electronic component positioning adjusting plates 311. The positioning adjusting plates 311 are formed by dividing a cylinder into four equal parts, as shown in FIG. 11, and are fixed to the respective one end of shafts 312 (FIG. 1) inserted into the third rotary drum 30. The other end of each shaft 312 has a keep plate 313 fixed thereto, and a coiled spring 314 is installed around the shaft 312 between the keep plate 313 and the rear surface of the third rotary drum 30. The coiled spring 314 urges the keep plate 313 to the right as viewed in FIG. 1, and hence the positioning adjusting plates 311 are urged by the coiled spring 314 to abut against the front surface of the third rotary drum 30.

Figure 12:
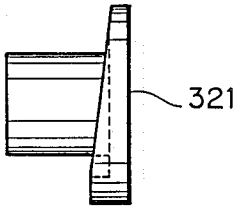
FIG. 12 is a side view of a second cam.

On the other hand, a follower 318 is fixed to the front portion of each positioning adjusting plate 311. The follower 318 is engaged with and opposed to a cam 321 which is fixed to the frame 320. The cam 321 has a shape shown in FIG. 12, such that the cam surface projects forward as the lower region is approached. Thus, the four positioning plates 311 are pushed forward as they are progressively positioned in the lower region of the third rotary drum 30.

Further, the outer peripheral edge of each positioning adjusting plate 311 is also formed with pawls 322 of the same pitch and the same shape as the pawls 301 and 302, and lead wire retaining portions 323 (FIG. 11) between the pawls 322. Thus, an electronic component 5 (not shown in FIG. 1) held on the outer peripheral surface of the third rotary drum 30 is delivered to a predetermined position as the pawl 322 abut against the electronic component element 4 (FIG. 2A) and move it forward. By suitably selecting the amount of forward movement of the positioning adjusting plates 311, the position of the electronic component 5 relative to the third rotary drum 30 can be correctly adjusted.

On the other hand, as is clear from FIG. 3, disposed below the third rotary drum 30 is a roller 41 constituting tape body feeding means, and a tape body 8 is fed via the roller to the outer peripheral surface of the third rotary drum 30 to the recess between the pawls 301 and 302 (FIG. 1). Therefore, the tape body 8 will be fed to the third rotary drum 30 in advance, and the lead wires 3 of the electronic components 5 will be placed on the upper surface of the said tape body 8.

Figure 2B:
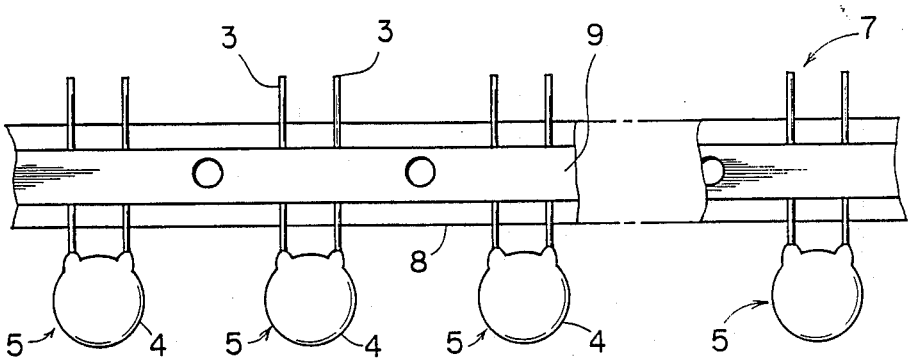
FIG. 2B is a plan view showing a taped electronic component series.

Further, disposed at the lower right of the third rotary drum 30 are rollers 51 and 52 forming adhesive tape feeding means, as shown in FIG. 3. The roller 52 is pressed against the outer peripheral surface of the third rotary drum 30. The adhesive tape 9 is applied to the tape body 8 on the outer peripheral edge of the third rotary drum 30 by the roller 52. Thus, the lead wires, 3 of the electronic components 5 are nipped between the tape body 8 and the adhesive tape 9 and the taped electronic component series 7 shown in FIG. 2B is thus completed.

In addition, it is preferable that the positioning adjusting plates 311 be delivered most forwardly between a region of contact between the third rotary drum 30 and the pressing roller 52 and a region where the taped electronic component series 7 separates from the third rotary drum 30 (a region of contact between the third drum 30 and the roller 54). Thus, the cam 321 is shaped such that its cam surface projects most forwardly in the regions indicated by Q and R in FIG. 3.

Disposed below the roller 54 is a feed roller 55 for discharging the taped electronic component series 7 out of the apparatus.

In the above embodiment, a first pitch between the pawls 103 and 104, that is, the pitch between the lead wire retaining portions 105 and 106, differs from a second pitch between the lead wire retaining portions 203 of the second rotary drum 20. As a result, when the electronic components 5 are transferred from the first rotary drum 10 to the second rotary drum 20, the pitch between the electronic components 5 is simultaneously changed. If such a change in pitch between the electric components 5 is not required, the pitches in the lead wire retaining portions formed around the outer peripheral edges of the rotary drums 10 and 20 can be equal to each other and the peripheral speeds of the rotary drums 10 and 20 can be equal to each other. In general, by suitably selecting the first and second pitches, and by adjusting the speeds at which the rotary drums 10 and 20 rotate, it is possible to easily obtain taped electronic component series 7 having electric components 5 disposed at various pitches differing from the pitch between the electronic components 5 in the electronic component assembly 6.

Further, when an electronic component 5 is not retained in one of the lead wire retaining portions 203, the third rotary drum 30 is stopped for a certain period of time and driven again according to the output from the sensor 226, whereby a taped electronic component series 7 having no missing electronic component 5 can be positively obtained.

Although the present invention has been described and illustrated in detail, it is clearly understood that the same is by way of illustration and example only and is not to be taken by way of limitation. The scope of the present invention should be limited only by the terms of the appended claims.

What is claimed is:

1. An apparatus for handling electronic components, said apparatus comprising:

(A) advancing means for advancing an elongated support member in a first direction, said elongated support member having a plurality of electronic components supported thereon;

(B) extracting means for automatically extracting said electronic components from said elongated support member in a second direction while said elongated support member is advancing in said first direction, said second direction being substantially perpendicular to said first direction; and (C) means for placing said extracted electronic components between first and second opposed elongated tapes to fix said electronic components between said tapes;

wherein said advancing means includes a first rotatable drum;

wherein said extracting means includes: movable plates which are rotatable together with said drum; and means for moving said plates in said second direction while said plates rotate together with said drum.

2. The apparatus of claim 1, wherein said drum has outer peripheral edges, said drum having retaining portions on said edges for receiving lead wires of said electronic components.

3. The apparatus of claim 2, wherein said advancing means includes a belt for pressing said support member against said drum.

4. The apparatus of claim 1, wherein said plates include retaining portions for receiving lead wires of said electronic components.

5. The apparatus of claim 4, wherein said drum has retaining portions for receiving said lead wires, said retaining portions of said drum being spaced apart from each other with a first pitch, said retaining portions of said plates being spaced apart from each other with said first pitch.

6. The apparatus of claim 4, wherein there is a one-to-one correspondence between said plates and said retaining portions.

7. The apparatus of claim 1, wherein said means for moving said plates includes:

first urging means for urging said plates toward said drum; and a cam for moving said plates away from said drum while said plates rotate together with said drum.

8. The apparatus of claim 1, further comprising:

a second rotatable drum for receiving said electronic components from said first drum; and a third rotatable drum for receiving said electronic components from said second drum.

9. The apparatus of claim 8, further comprising guide elements for guiding said electronic components, said guide elements being associated with said drums.

10. The apparatus of claim 8, wherein each one of said first, second, and third drums includes retaining portions for receiving lead wires of said electronic components, said retaining portions of said third drum overlapping said retaining portions of said second drum.

11. The apparatus of claim 10, further comprising positioning means for positioning said electronic components with respect to said first tape.

12. The apparatus of claim 11, wherein said positioning means includes:

a plurality of peripheral plates which are rotatable together with said third drum; and a cam for moving said peripheral plates in said second direction while said peripheral plates rotate together with said third drum.

13. The apparatus of claim 12, wherein said third drum has an outer peripheral edge, said peripheral plates conforming to said outer peripheral edge of said third drum, said peripheral plates having lead wire retaining portions corresponding to said retaining portions of said third drum.

14. The apparatus of claim 13, wherein said means for placing said extracted electronic components between said tapes to fix said components between said tapes includes:

means for feeding said first tape onto and around the outer peripheral surface of said third drum; and means for feeding said second tape onto said first tape while said first tape is on said outer peripheral surface of said third drum.

15. The apparatus of claim 14, wherein said retaining portions of said first drum are spaced from each other with a first pitch, said retaining portions of said second drum being spaced from each other with a second pitch, said second pitch being different than said first pitch.

16. The apparatus of claim 1, further comprising a sensor for detecting the presence or absence of an electronic component within said apparatus.

17. An apparatus for handling electronic components, comprising:

a first rotary drum, said first rotary drum having an outer peripheral edge, an end surface, and lead wire retaining portions for retaining lead wires of electronic components on a support member of an electronic component assembly, said lead wire retaining portions being located around said outer peripheral edge, said retaining portions being spaced from each other at a first pitch corresponding to the pitch between said electronic components;

support member pressing means for pressing said support member against said first rotary drum;

a plurality of electronic component extracting means, said electronic component extracting means being rotatable together with said first rotary drum, and means for moving said electronic component extracting means away from said end surface of said first rotary drum, said electronic component extracting means defining an outer peripheral edge with lead wire retaining portions for retaining said lead wires of said electronic components, said lead wire retaining portions of said electronic component extracting means being spaced from each other at the same pitch as said lead wire retaining portions of said first rotary drum;

first urging means for urging said electronic component extracting means against said end surface of said first rotary drum;

a first cam for moving said electronic component extracting means away from said end surface of said first rotary drum to extract said electronic components from said support member while said support member is on said first rotary drum;

a second rotary drum having an outer peripheral surface and lead wire retaining portions for receiving said lead wires of said electronic components, said lead wire retaining portions of said second rotary drum being located around said outer peripheral surface of said second rotary drum, said lead wire retaining portions of said second rotary drum being spaced from each other at a second pitch and positionable adjacent said lead wire retaining portions of said first rotary drum;

a third rotary drum having an end surface, an outer peripheral surface, and lead wire retaining portions for receiving said lead wires of said electronic components, said lead wire retaining portions of said third rotary drum overlapping said lead wire retaining portions of said second rotary drum;

a plurality of electronic component positioning means which are rotatable together with said third rotary drum, said electronic component positioning means defining an outer peripheral edge which conforms to said outer peripheral surface of said third rotary drum, said electronic component positioning means having lead wire retaining portions which are spaced apart from each other by the same pitch as said lead wire retaining portions of said third rotary drum;

second urging means for urging said electronic component positioning means against said end surface of said third rotary drum;

means for feeding a tape body onto said outer peripheral surface of said third rotary drum;

a second cam for moving said electronic component positioning means away from said third rotary drum to position said electronic components on said tape body; and means for feeding an adhesive tape onto said tape body while said tape body is on said outer peripheral surface of said third rotary drum.

* * * * *